US006082772A

United States Patent [19]

Matsumoto et al.

[11] Patent Number: 6,082,772

[45] Date of Patent: Jul. 4, 2000

[54] AUTOMATIC INSERTION BOOKMARK

[76] Inventors: Shinsuke Matsumoto; Naomi Matsumoto, both of 562-2, Oaza mada, Nakatsu-shi, Oita 871-0025, Japan

[21] Appl. No.: 09/424,410

[22] PCT Filed: Jan. 27, 1999

[86] PCT No.: PCT/JP97/00341

§ 371 Date: Nov. 23, 1999

§ 102(e) Date: Nov. 23, 1999

[87] PCT Pub. No.: WO99/38708

PCT Pub. Date: Aug. 5, 1999

[30] Foreign Application Priority Data

| | | | |
|---|---|---|---|
| Jan. 31, 1998 | [JP] | Japan | 10-033771 |
| Aug. 10, 1998 | [JP] | Japan | 10-239544 |
| Dec. 30, 1998 | [JP] | Japan | 10-377326 |

[51] Int. Cl.[7] ..... B42D 9/00

[52] U.S. Cl. ..... 281/42; 116/234

[58] Field of Search ..... 116/234, 238, 116/239; 281/42, 36, 28, 51

[56] References Cited

U.S. PATENT DOCUMENTS

| | | | |
|---|---|---|---|
| 2,633,372 | 3/1953 | Wilson | 281/42 |
| 4,574,727 | 3/1986 | Martin | 116/234 |
| 5,408,950 | 4/1995 | Porto | 281/42 |
| 5,439,254 | 8/1995 | Dorion | 281/42 |
| 5,515,809 | 5/1996 | Weinberg | 116/239 |

FOREIGN PATENT DOCUMENTS

| | | |
|---|---|---|
| 48-73057-01 | 12/1971 | Japan . |
| 51-155948 | 5/1975 | Japan . |
| 58-187461 | 12/1983 | Japan . |
| 61-105175 | 7/1986 | Japan . |
| 62-182770 | 11/1987 | Japan . |
| 63-161867 | 10/1988 | Japan . |
| 6-49068 | 7/1994 | Japan . |
| 6-83363 | 11/1994 | Japan . |
| 7-757 | 1/1995 | Japan . |
| 3010637 | 2/1995 | Japan . |

*Primary Examiner*—Willmon Fridie, Jr.

*Attorney, Agent, or Firm*—Armstrong, Westerman, Hattori, McLeland & Naughton

[57] ABSTRACT

An automatic insertion bookmark 10 designed to allow a bookmark portion 14 to be automatically inserted into and placed on an opened page 20*a* of a book 16. The bookmark 10 includes a fixing portion 12, a connecting portion 13, and a bookmark portion 14. The fixing portion 12 is either prefixed to one of the following or fixed thereto when the bookmark 10 is used: a back cover 18 of the book 16; a front cover 20 of the book 16; and, a leaf 19 of the book 16 in the immediate vicinity of either the back cover 18 or the front cover 20. A proximal end of the connecting portion 13 is connected to an upper portion of the fixing portion 12. Further, the bookmark portion 14 is connected to a distal end of the connecting portion 13. When the bookmark 10 is used, the bookmark portion 14 is folded downward at a portion where the bookmark portion 14 and the connecting portion 13 are joined together. As a result, the bookmark portion 14 is directed downward in an opposed relationship to the fixing portion 12.

5 Claims, 7 Drawing Sheets

FIG.1(A)
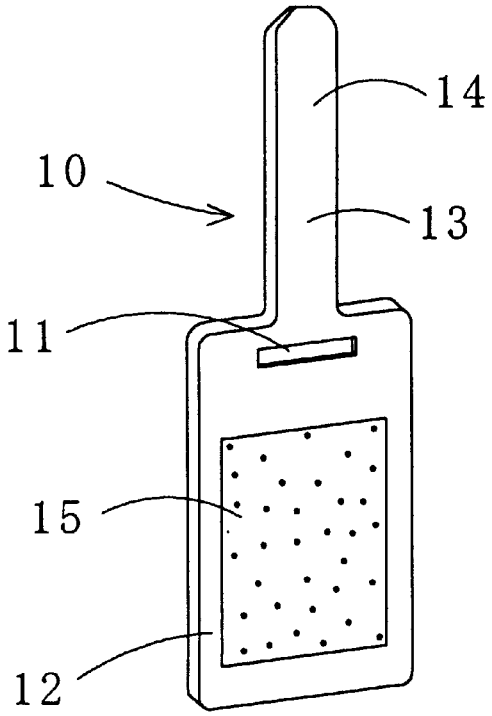
FIG.1(B)
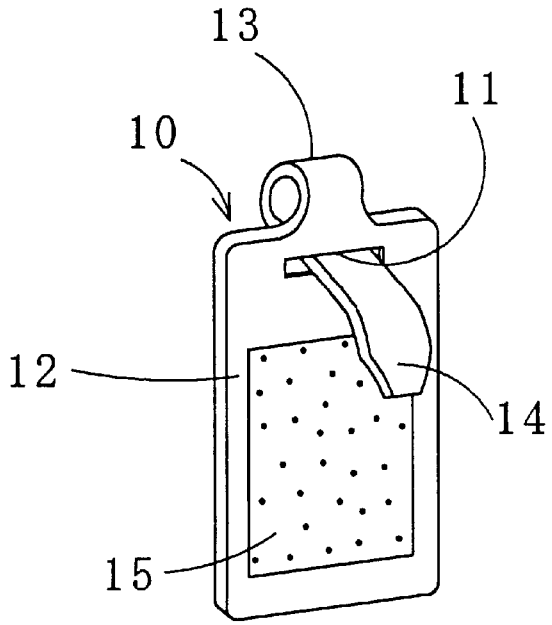
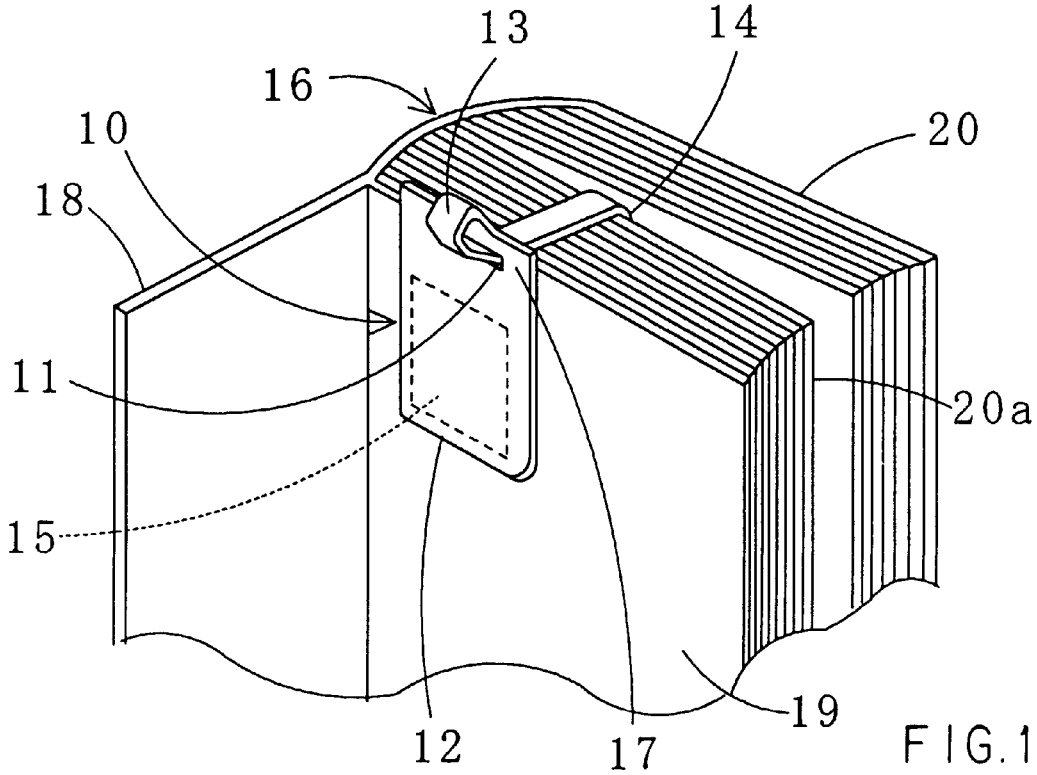
FIG.1(C)

AUTOMATIC INSERTION BOOKMARK

TECHNICAL FIELD

This invention relates to an automatic insertion bookmark fitted to a book, having a bookmark portion automatically inserted between pages of the book, which pages are just read.

BACKGROUND ART

People who read books usually either interpose a bookmark between leaves of the book or fold back the leaf when interrupting reading and then closing the book, so that they can readily locate a page where they stopped reading. However, the now people who lead a busy life often read books for a chain of very short periods of time, such as, e.g., time of a commute to attend office or school, and its associated waiting time. In such a case, people sometimes forget to insert the bookmark between the pages of the book, and thus read the same page again when resuming reading. In order to obviate such an inconvenience, an automatic insertion bookmark has been proposed, in which when reading is interrupted, then a bookmark portion is automatically inserted between pages that were opened immediately before the book is closed.

One example of such an automatic insertion bookmark is proposed in, e.g., published Japanese Utility Model Application Laid-Open No. 6-83363. The bookmark as proposed in this publication includes a fixing plate, a band-like elastic plate, and a tongue piece. The fixing plate has an angular C shaped nick. The elastic plate extends sideward from one side of the fixing plate at an upper portion thereof. The tongue piece is disposed on the underside of the elastic plate at a distal end thereof. When the bookmark is used, the fixing plate is fixed to a book by means of the aforesaid nick, and then the tongue piece is laid on an opened page of the book. In this state, when the page is turned over, then the tongue piece is automatically placed on the following page. When the book is closed, then the tongue piece is held, as such, on the page. Thus, the tongue piece realizes a purpose of the automatic insertion bookmark.

However, in the automatically placed bookmark as proposed in the above publication, the rectangular-shaped fixing plate, bandlike elastic plate, and tongue piece are formed by a sheet, and are planar in their entirety. Accordingly, when a large number of pages are read and then turned over, it follows that many leaves of the book are present between the fixing plate and the tongue piece. As a result, the elastic plate is bent into a S-shape, and is then subjected to bending stress or torsional stress. This causes a problem that the tongue piece fails to reliably follow sequentially opened pages.

A further problem with the above bookmark is a poor appearance because the upper portion of the fixing plate and the entire surface of the elastic plate extend outward from the top of the book.

Another automatic insertion bookmark is proposed in published Japanese Patent Application Laid-Open No. 63-21192. The bookmark according to this publication includes fixing members and a string-like object. The fixing members are independent and separated from one another. The string-like object is made of a shrinkable raw material that has a proper length. The string-like object is suspendingly spanned between the fixing members. The fixing members are fixed to a cover of a book at respective positions that are spaced apart from a corner of the cover by respective small distances. The string-like object for connecting the fixing members together is spanned between the fixing members so as to extend across a corner portion of a predetermined page of the book.

However, the automatic insertion bookmark as proposed in the above publication has a problem that two fixing members must laboriously be fitted to the book. Further, the string-like object, which is made of a resilient member, must be fitted with some degree of tension. This brings about another problem that wrinkles in leaves of the book or the tendency of the leaves to bend would occur when the book is small in thickness because such tensioned string-like object pulls the corner portion of the book.

DISCLOSURE OF INVENTION

In view of the above, an object of the present invention is to provide an automatic insertion bookmark free to use for any book regardless of whether the book is greater or smaller in thickness, in which when opened and read pages of the book are closed, then a bookmark portion is brought into reliable insertion between such closed pages.

The automatic insertion bookmark according to the present invention, which serves the above object, is designed to allow the bookmark portion to be automatically inserted into and placed on an opened page of the book at an upper portion of the page. The automatic insertion bookmark includes a fixing portion fixed to the book, the bookmark portion interposed between the pages that are just read, and a connecting portion for connecting the fixing portion and the bookmark portion together. A proximal end of the connecting portion is connected to an upper portion of the fixing portion. The connecting portion is folded either at one position where the connecting portion and the fixing portion are seamlessly joined together or at another position adjacent to the former position. The bookmark portion is folded either at one position where the connecting portion and the bookmark portion are seamlessly joined together or at another position adjacent to the former position. As a result, the bookmark portion is directed downward in an opposed relationship to the fixing portion. Accordingly, the interconnected fixing, connecting, and bookmark portions assume an inverted U-shape in their entirety when seen from the side thereof during use thereof.

In the automatic insertion bookmark having the above construction, when the fixing portion is fixed to an upper portion of, e.g., either a front cover of the book or a back cover of the book, or alternatively a leaf of the book in the immediate vicinity of the front or back cover, then the bookmark portion is automatically placed on an opened page of the book. Further, when the page is turned over, then the bookmark portion is laid on the following page. When reading is stopped and then the book is closed, then the bookmark portion is automatically inserted between closed leaves of the book.

The fixing portion preferably has an adhesive agent layer formed on the front or reverse side thereof for either tentatively fixing or fixing the fixing portion to the front or back cover of the book, or alternatively to the leaf of the book in the immediate vicinity of the aforesaid front or back cover. Thus, the fixing portion can be readily fixed to the book at any predetermined position thereof. In this connection, the above phrase "tentatively fixing the fixing portion" shows a state in which the fixing portion affixed to the book at one position thereof is removed therefrom, and is then re affixed to the book at another predetermined position, thereby providing continuing use of the automatic insertion bookmark. Further, similarly to universally available bookmarks, a sheet of elastic paper, which is pliable to a certain degree, is preferably used by way of a material of the automatic insertion bookmark. Alternatively, the automatic insertion bookmark may be made of either a plastic sheet having flexibility or, in extreme cases, a metal plate.

In the automatic insertion bookmark according to the present invention, an insertion through hole can be formed at the upper portion of the fixing portion, which upper portion is connected to the connecting portion. The hole is formed by a transversely elongated hole, through which the bookmark and connecting portions can be inserted. Further, the interconnected bookmark and connecting portions are inserted through the insertion-through hole in a state of the connecting portion being folded back at a certain portion thereof. As a result, the bookmark portion is readily directed downward in an opposed relationship to the book. Consequently, the bookmark portion can be placed on an opened page of the book without allowing a bold crease to be formed at a position where the connecting portion and the bookmark portion are seamlessly joined together.

In another automatic insertion bookmark according to the present invention, a fixing portion, a connecting portion, and a bookmark portion may be formed by profiles thereof being cut out from either a front cover of a book or a back cover of the book, or alternatively from a leaf of the book in the immediate vicinity of the aforesaid front or back covers. A proximal end of the fixing portion is seamlessly joined to an upper portion of either the front cover or the back cover, or alternatively to an upper portion of the aforesaid leaf. Then, when the automatic insertion bookmark is used, the proximal end of the fixing portion is folded back. As a result, the insertion-through hole, which is formed at an upper portion of the fixing portion, is allowed to protrude from the top of the book. Thus, the automatic insertion bookmark can be incorporated in each book during its manufacturing process. In addition, such a built-in bookmark eliminates troubles such as loss of the bookmark during use thereof.

In yet another automatic insertion bookmark according to the present invention, interconnected connecting and bookmark portions may be formed in a sheet of a fixing portion by being cut out from the sheet of the fixing portion. A proximal end of the connecting portion is foldably connected to an upper portion of the fixing portion. Then, when the automatic insertion bookmark is used, the bookmark and connecting portions are pulled from the fixing portion. In this way, the connecting and bookmark portions having respective predetermined shapes are formed. With the automatic insertion bookmark having the above construction, a sheet of paper may be press formed with a nick in order to produce the automatic insertion bookmark.

In a further automatic insertion bookmark according to the present invention, interconnected connecting and bookmark portions may be bent by being folded back at one position where integrally interconnected fixing and connecting portions are seamlessly joined together, or alternatively at another position of the connecting portion adjacent to the former position. The folded connecting portion is further bent at an intermediate position thereof in a direction opposite to the direction in which the connecting portion was previously folded back. As a result, the bookmark portion, which is bent and seamlessly joined to a distal end of the connecting portion, remains directed downward. Thus, the automatic insertion bookmark that is extremely easy to manufacture and use is provided.

In the above-described automatic insertion bookmark, the fixing, connecting, and bookmark portions are desirably formed seamlessly by a single sheet, thereby making it possible to produce the automatic insertion bookmark at lower costs.

In a yet further automatic insertion bookmark according to the present invention, interconnected connecting and bookmark portions may be formed by a sheet different from a sheet of a fixing portion. A proximal end of the connecting portion is secured to an upper portion of the fixing portion. As a result, the bookmark portion is directed in a downward direction of the fixing portion, whereby the automatic insertion bookmark is folded at smaller angles at one demarcation portion between the fixing portion and the connecting portion and at another demarcation portion between the connecting portion and the bookmark portion. Consequently, the automatic insertion bookmark having the following features is provided: the bookmark portion is readily inserted into the book by being slightly bent; and, the inserted bookmark portion is less likely to break loose from the book.

BRIEF DESCRIPTION OF THE DRAWINGS

FIG. 1(A), 1(B), and 1(C) are descriptive illustrations, showing an automatic insertion bookmark according to a first embodiment of the present invention;

BEST MODE FOR CARRYING OUT THE INVENTION

Figure 2A:
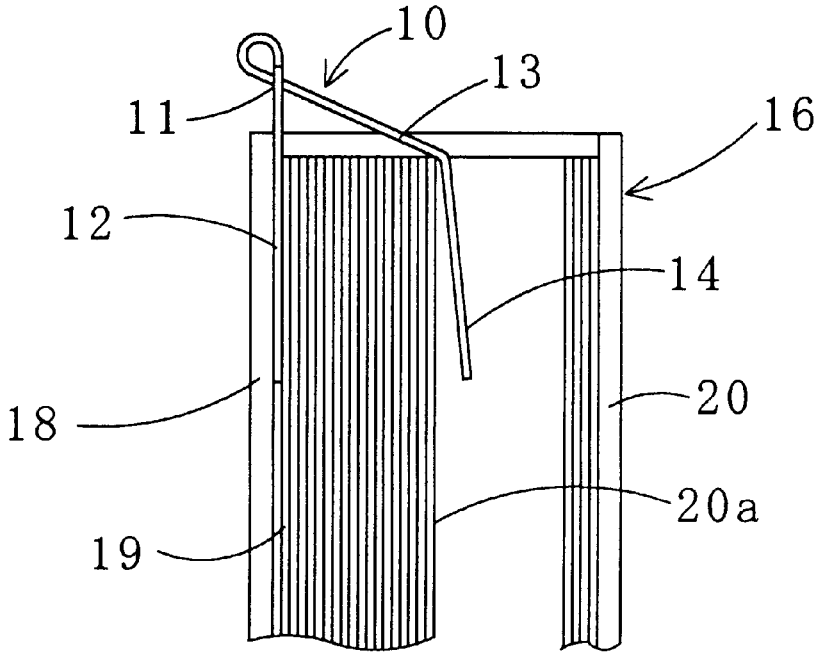
FIGS. 2(A), 2(B), and 2(C) are cross-sectional views, illustrating how the automatic insertion bookmark is used.

As illustrated in FIGS. 1(A), 1(B), and 1(C), an automatic insertion bookmark 10 according to a first embodiment of the present invention assumes a planar shape when being unused. The automatic insertion bookmark 10 is made of a sheet of synthetic resin having elasticity (or alternatively, a sheet of paper, a rubber sheet, etc.). The bookmark 10 includes a fixing portion 12, a connecting portion 13, and a bookmark portion 14. The fixing portion 12 has a transversely elongated hole (slot) 11 at an upper portion thereof by way of one example of a insertion-through hole. The connecting portion 13 is integrally connected to the fixing portion 12 at the uppermost central portion thereof. The bookmark portion 14 is seamlessly joined as one-piece to the connecting portion 13 at an upper portion thereof. These components will now be described in detail.

The fixing portion 12 is fabricated from a rectangular sheet (e.g., nearly 3–4 cm wide by 4–5 cm long) whose four corners are arcuately chamfered. An adhesive agent layer 15 is formed on one of both sides of the fixing portion 12. When the adhesive agent layer 15 is unused, a protective sheet is attached to the surface of the adhesive agent layer 15. The protective sheet is made of a sheet of synthetic resin or the like. Meanwhile, when the bookmark 10 is used, then the protective sheet is detached from the surface of the adhesive agent layer 15 in order to expose the adhesive agent layer 15. The adhesive agent layer 15 is preferably formed by a bonding agent that has a reduced level of adhesive strength such as to permit continual use. As shown in FIG. 1(C), the adhesive agent layer 15 may be formed over the entire surface of the fixing portion 12 except for an exposed portion 17. The exposed portion 17 is part of the fixing portion 12, which is displayed from the top of a book 16 when the bookmark 10 is used. Alternatively, as shown in FIG. 1(A), the adhesive agent layer 15 may be formed on the surface of the fixing portion 12 except for the exposed portion 17, and further except for an about 3 to 4 mm wide area that is surrounded by the periphery of the fixing portion 12. No bonding agent is applied over that particular area.

The connecting portion 13 and the bookmark portion 14 are seamlessly joined together as one-piece at the uppermost central portion of the fixing portion 12. The connecting portion (also an elastic portion) 13 and the bookmark portion 14 are formed into a band shape having a width of nearly 5 to 7 mm. The connecting and bookmark portions 13, 14 are desirably made of a transparent sheet of synthetic resin. In particular, since the bookmark portion 14 is laid on a page of the book 16, the bookmark portion 14 is preferably formed by a transparent sheet of synthetic resin or the like, as otherwise the book is rendered illegible. There exists no definite demarcation between the connecting portion 13 and the bookmark portion 14. The bookmark portion 14 includes a rounded distal end. According to the present embodiment, the connecting and bookmark portions 13, 14 are some 3 to 5 cm in full length, but may be made longer when the book is larger in thickness.

The transversely elongated hole 11 is formed at the upper portion of the fixing portion 12, and the interconnected bookmark and connecting portions 14, 13 are fitted into the hole 11. The width of the hole 11 in a transverse direction of the fixing portion 12 is greater than widths of the bookmark and connecting portions 14, 13 by nearly 1 to 2 mm so as to allow the bookmark and connecting portions 14, 13 to be loosely inserted into the hole 11.

According to this embodiment, the hole 11 has a clearance of some 0.5 to 1.5 mm formed in a vertical direction of the fixing portion 12. Alternatively, the transversely elongated hole according to the present invention may include a wider groove-shaped nick that has upwardly directed notches of 1 to 2 mm heights at both sides of the nick. In this case, the length of the nick in the transverse direction of the fixing portion 12 is slightly greater than the width of the connecting portion 13 in a transverse direction thereof. In addition, there is not a slightest clearance formed in the vertical direction of the fixing portion 12.

As illustrated in FIG. 1(C), when the automatic insertion bookmark 10 is used, the fixing portion 12 is glued onto a leaf 19 of the book 16 at an upper portion thereof through the exposed adhesive agent layer 15. The leaf 19 is a page that comes into view when a back cover 18 of the book 16 (or, a front cover 20 of the book 16) is turned over. In other words, the leaf 19 is a page present in the immediate vicinity of the back cover 18 (or, the front cover 20). When the fixing portion 12 is glued onto the leaf 19 as described above, the transversely elongated hole 11, which is located at the upper portion of the fixing portion 12, must be exposed at an upward position from the top of the book 16. Then, as shown in FIGS. 1(B) and 1(C), the interconnected bookmark and connecting portions 14, 13 are folded back gradually to insert the distal end of the bookmark portion 14 through the hole 11. The inserted bookmark portion 14 is then pulled, and the proximal end of the connecting portion 13 is thereby folded back to permit the connecting portion 13 to be inserted through the hole 11. Thereafter, as seen from FIG. 2(A), either the connecting portion 13 or the bookmark portion 14 is held in a folded state so as not to return to its original shape, and is then inserted between predetermined pages of the book 16.

Figure 2B:
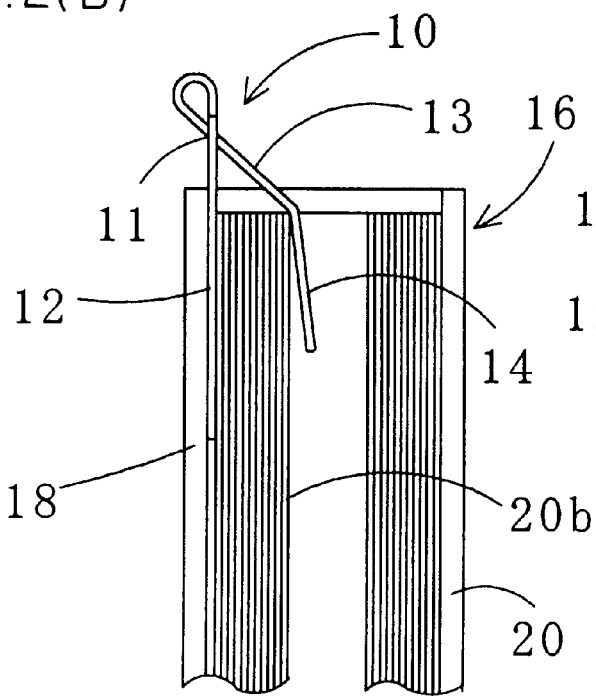
Figure 2C:
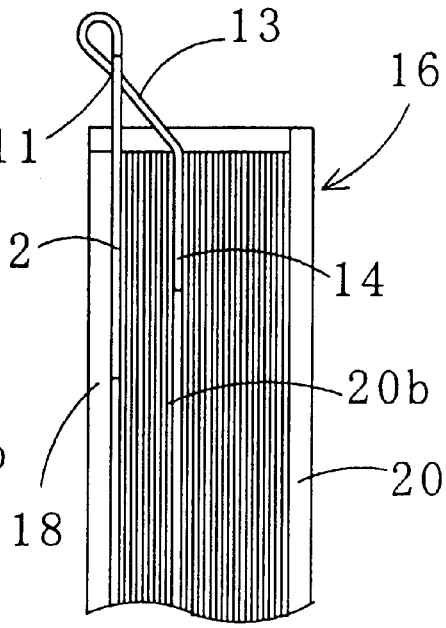

In this state, a leaf of the book 16 is turned over, as illustrated in FIG. 2(B). Then, the bookmark portion 14 is automatically placed on an opened page 20*b*, and is thereby inserted between the opened pages of the book 16. As illustrated in FIG. 2(C), when the book 16 is closed, then the bookmark portion 14 is left between the closed pages of the book 16. Therefore, when the book 16 is read again, reading can be resumed from the page 20*b*, on which the bookmark portion 14 is laid.

In this embodiment, the fixing portion 12 is mounted on the leaf that comes into view when the back cover 18 is turned over (i.e., the leaf 19 in the immediate vicinity of the back cover 18). Alternatively, the fixing portion 12 may be fitted directly onto the back cover 18. In some cases, the fixing portion 12 may be secured to the front cover 20.

As previously described, the automatic insertion bookmark 10 is used in a state of the connecting portion 13 being inserted into the transversely elongated hole 11. This structure provides an advantage in that the bookmark portion 14 is readily oriented toward the fixing portion, whereby the bookmark portion 14 inserted between the pages of the book 16 is resistant to dislodgment therefrom.

Figure 3A:
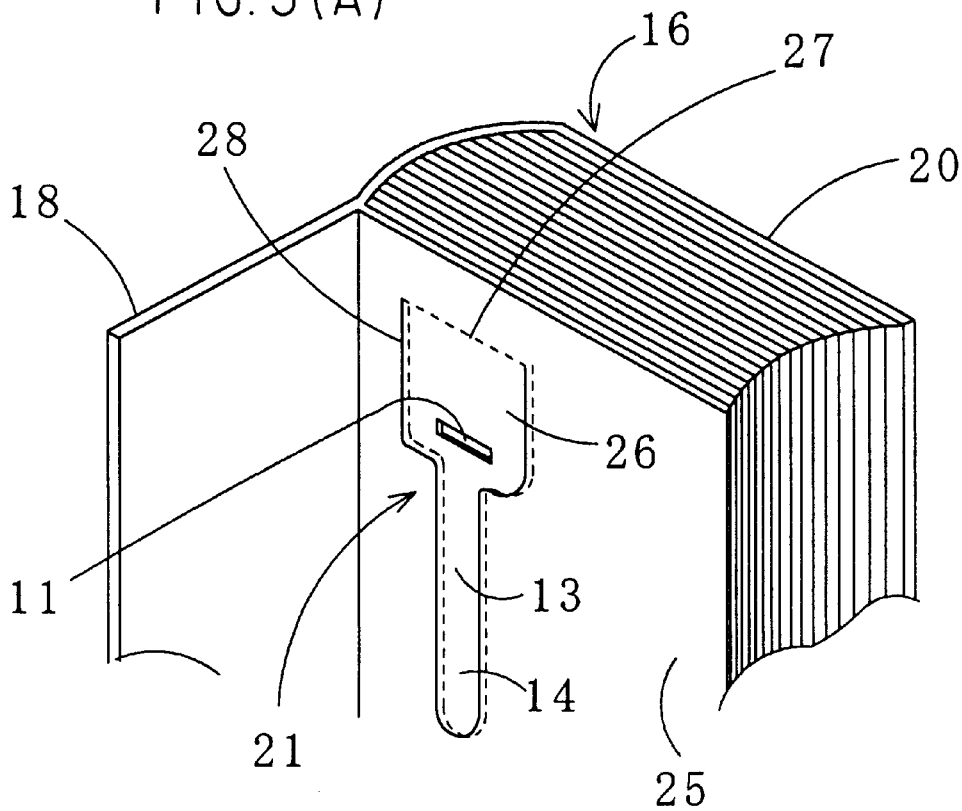
FIGS. 3(A) and 3(B) are descriptive illustrations, showing an automatic insertion bookmark according to a second embodiment.
Figure 3B:
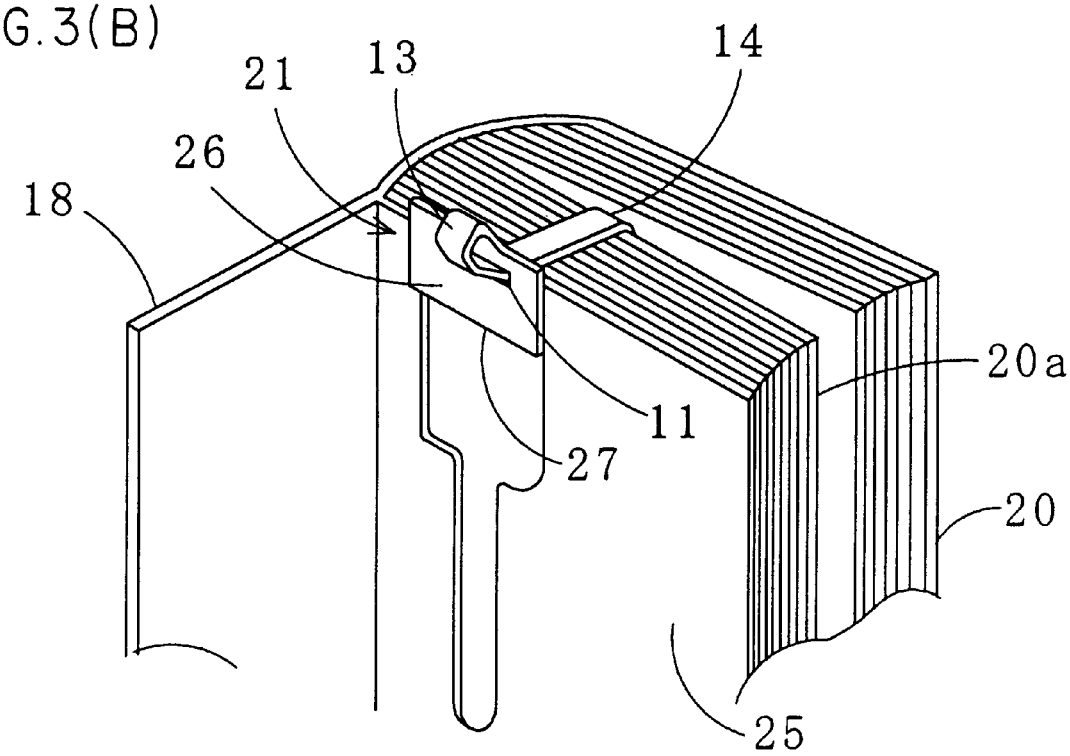

Another automatic insertion bookmark 21 according to a second embodiment as shown in FIGS. 3(A) and 3(B) will now be described. It is noted that the same reference numerals are hereinafter given for components identical to those of the bookmark 10 according to the previous embodiment; therefore, detailed descriptions related thereto will be omitted. (This rule applies to all hereinafter described embodiments.)

The automatic insertion bookmark 21 according to this embodiment is formed by respective profiles of a fixing portion 26, a connecting portion 13, and a bookmark portion 14 being cut out from a leaf 25 of a book 16. The leaf 25 is a page in the immediate vicinity of a back cover 18 (or, a front cover 20) of the book 16 (i.e., the leaf 25 is a page which comes into view when the back cover 18 is turned over). The connecting and bookmark portions 13, 14 are seamlessly joined as one-piece to the fixing portion 26. No adhesive agent layer is formed on the fixing portion 26. Instead, a proximal end of the fixing portion 26 is seamlessly joined to the leaf 25 through a folding line 27. The folding line 27 is not necessarily required to form in advance. As shown in FIG. 3(B), the fixing portion 26 is formed at a position which causes a transversely elongated hole 11 to be exposed from the top of the book 16 when the fixing portion 26 is folded back. The hole 11 is formed at an upper portion of the fixing portion 26. Reference numeral 28 denotes a line, along which the automatic insertion bookmark 21 is cut out.

When the automatic insertion bookmark 21 is used, the interconnected fixing, connecting, and bookmark portions 26, 13, 14 formed along the cutout line 28 are pulled and then folded back at the folding line 27, thereby standing the fixing portion 26. Then, the bookmark portion 14 and the connecting portion 13 are inserted through the hole 11. The inserted bookmark portion 14 is folded at a proximal end thereof. Then, the folded bookmark portion 14 is laid on a leaf 20*a* that has been turned up (opened), and is thereby inserted between pages of the book 16, which pages are just read. Thus, the bookmark portion 14 is automatically inserted between the pages that are just read.

Figure 4:
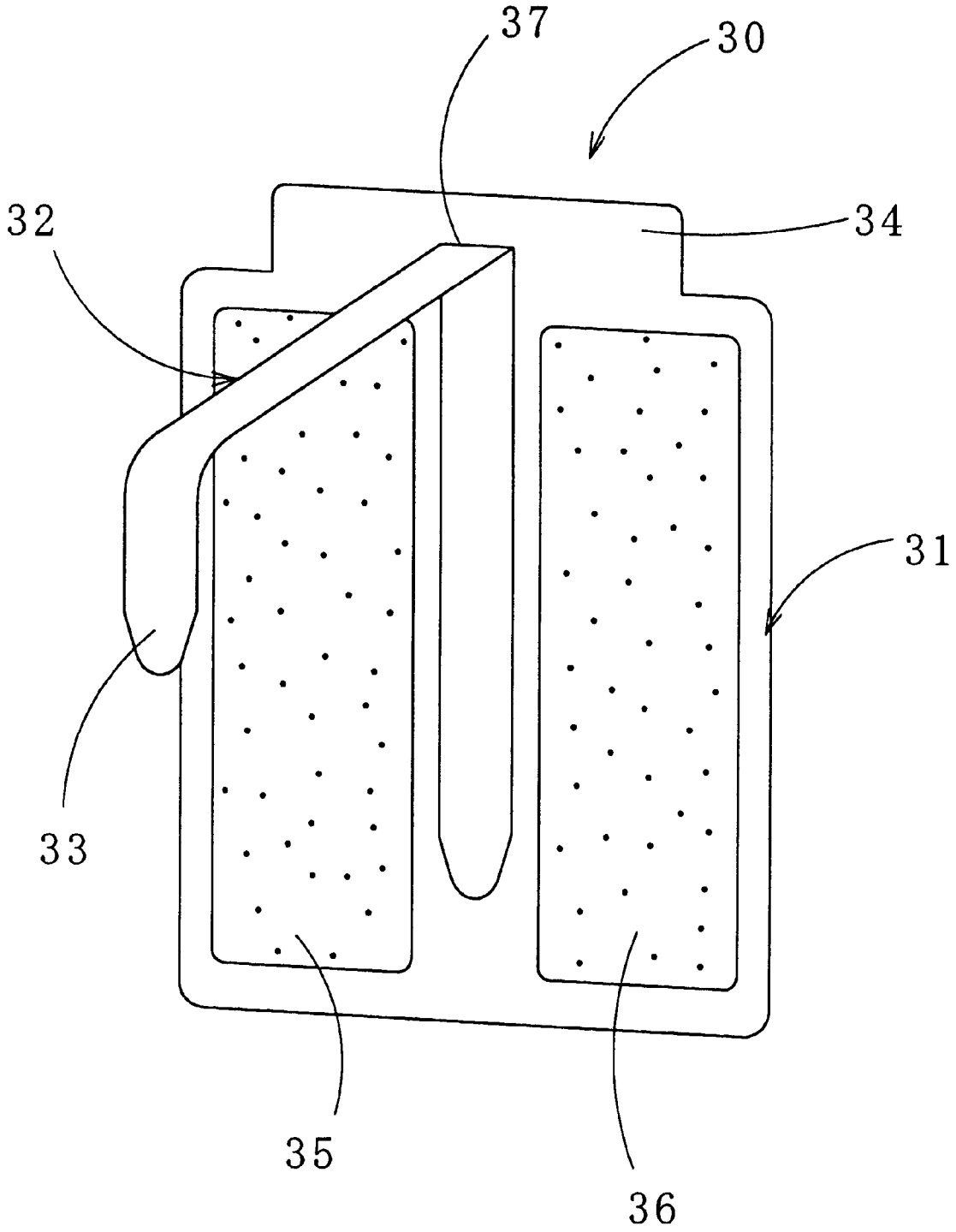
FIG. 4 is a perspective view, illustrating an automatic insertion bookmark according to a third embodiment.

Next, still another automatic insertion bookmark 30 according to a third embodiment as shown in FIGS. 4 and 5 will be described. The automatic insertion bookmark 30 as shown in FIG. 4 is made of either a sheet of synthetic resin or a paper member, both of which have elasticity and flexibility. The bookmark 30 includes a fixing portion 31 affixed to a book, a connecting portion 32 foldably seamlessly joined to the fixing portion 31 at an upper position thereof, and a bookmark portion 33 monolithically connected to a distal end of the connecting portion 32.

The fixing portion 31 is substantially similar in size to that of the bookmark 10 according to the first embodiment. The fixing portion 31 includes a protruding portion 34 at an upper portion thereof. The protruding portion 34 is smaller in width than the main body of the fixing portion 31. The fixing portion 31 has a pair of continually jointable adhesive agent layers 35, 36 formed on either the surface of the main body or the reverse side of the main body on the right and left sides thereof. The adhesive agent layers 35, 36 usually have respective protective sheets attached to surfaces thereof. When the bookmark 30 is used, the protective sheets are detached from the surfaces of the adhesive agent layers 35, 36 to expose the adhesive agent layers 35, 36.

Figure 5A:
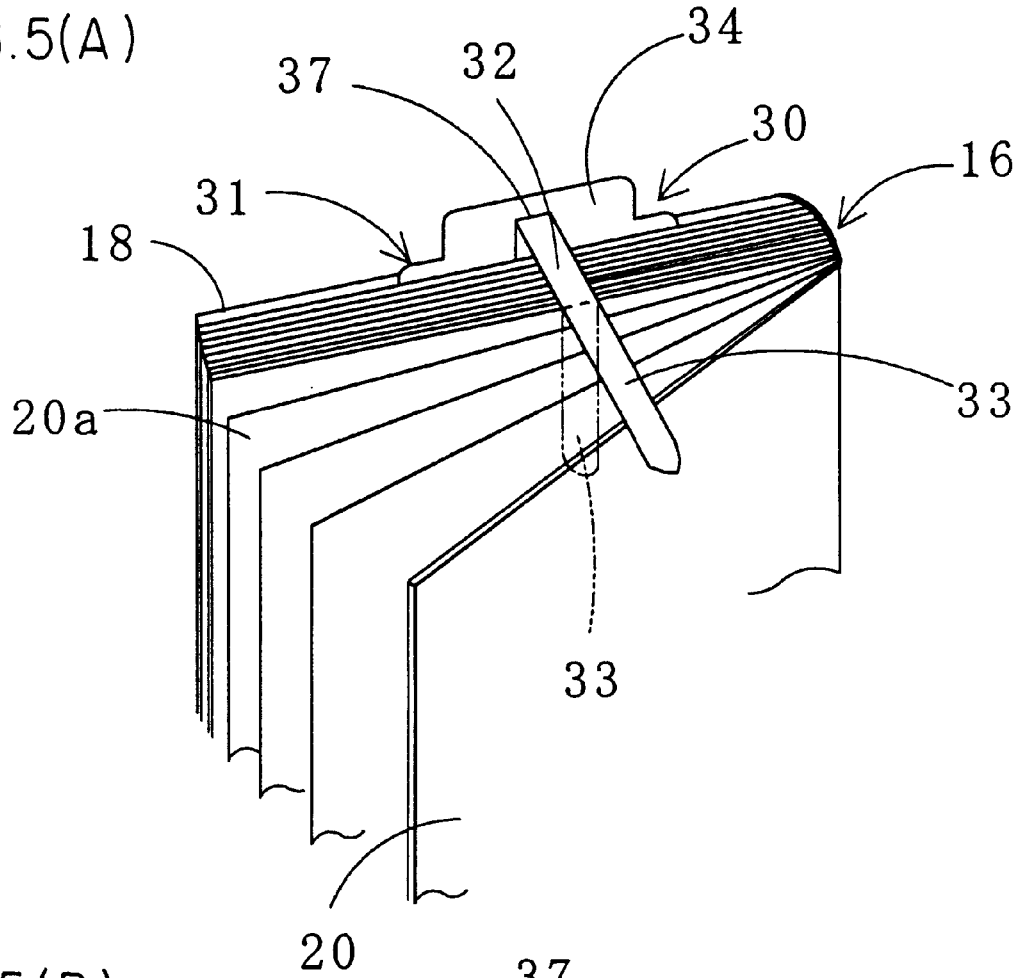
FIGS. 5(A) and 5(B) are perspective view, illustrating how the automatic insertion bookmark is used.
Figure 5B:
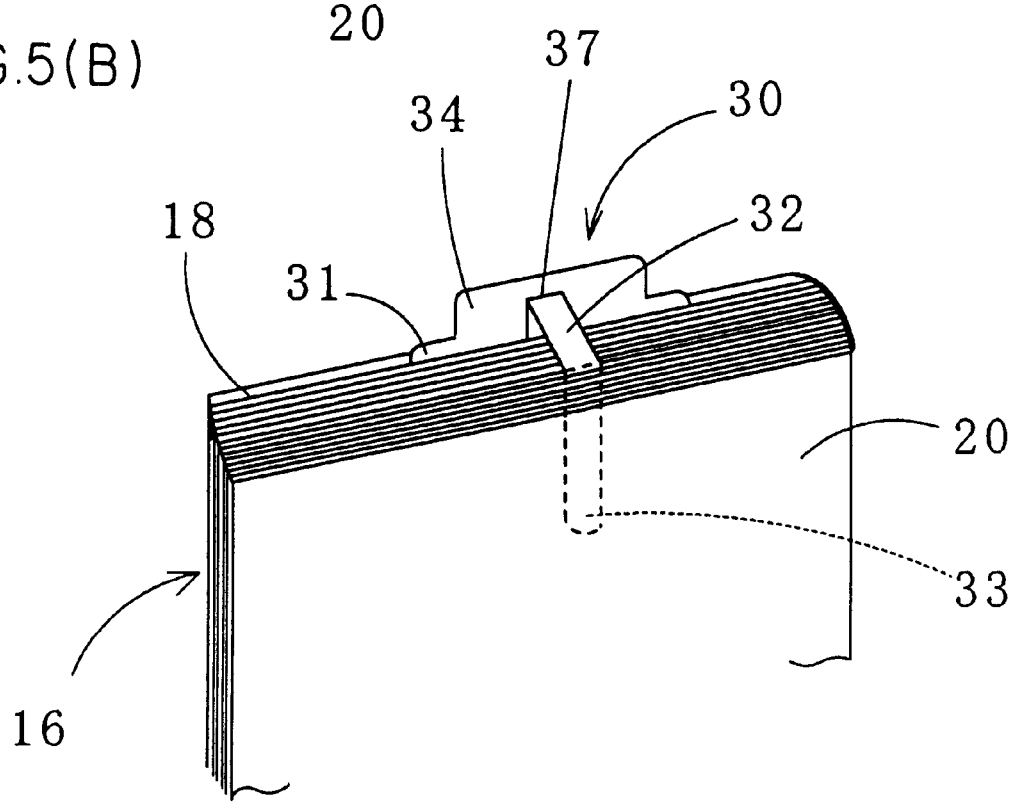

The band-like connecting portion 32 and the bookmark portion 33 are positioned at a central portion of the fixing portion 31 so as to be freely cut out therefrom. In addition, a proximal end of the connecting portion 32 is foldably connected to the protruding portion 34. As shown in FIG. 4, when the automatic insertion bookmark 30 is used, the connecting portion 32 and the bookmark portion 33 are pressed out of the fixing portion 31. Then, the proximal end of the connecting portion 32 is bent along a folding line 37 at a substantially right angle. Further, the bookmark portions 33 is folded at a demarcation portion between the connecting portion 32 and the bookmark portion 33. In this state, as illustrated in FIGS. 5(A) and 5(B), the fixing portion 31 is fixed to a book 14 by means of the adhesive agent layers 35, 36. More specifically, the fixing portion 31 is secured to an upper portion of either a front cover 20 of the book 16 or a back cover 18 of the book 16, or alternatively to an upper portion of a leaf of the book 16 in the immediate vicinity of the front cover 20 or the back cover 18. Then, the bookmark portion 33 is placed on a predetermined page 20*a*, i.e., either a page that is just read or the following page. As shown in FIG. 5(B), when the book 16 is closed, then the bookmark portion 33 is automatically inserted between the closed pages of the book 16.

Figure 6A:
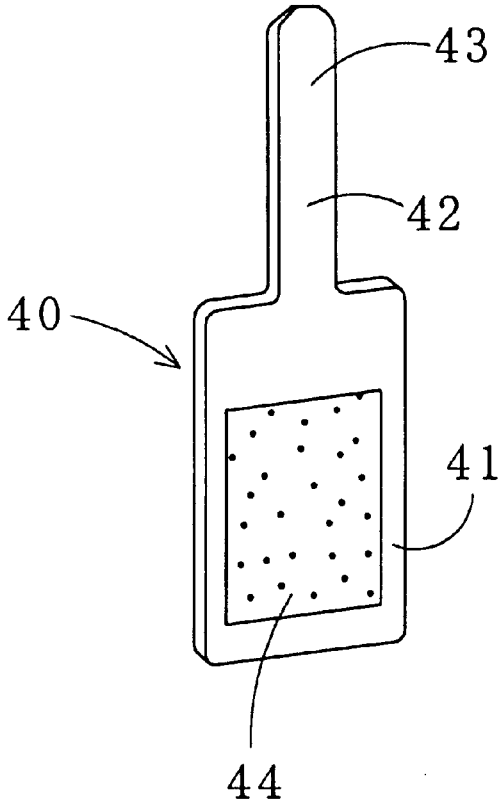
FIGS. 6(A), 6(B), and 6(C) are descriptive illustrations, showing how an automatic insertion bookmark according to a fourth embodiment is use; and, FIGS. 7(A) and 7(B) are descriptive illustrations, showing an automatic insertion bookmark according to a fifth embodiment.
Figure 6B:
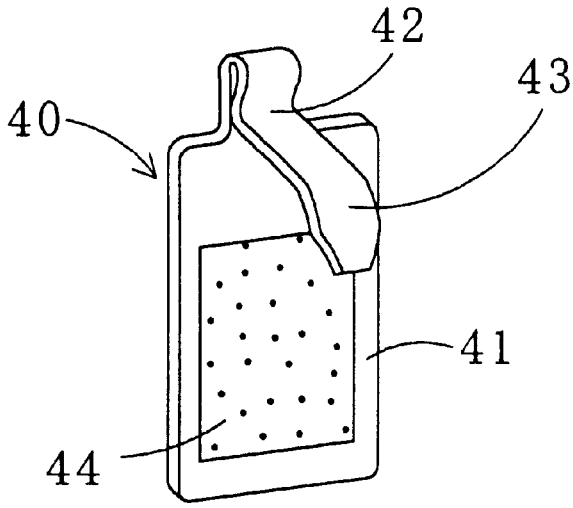
Figure 6C:
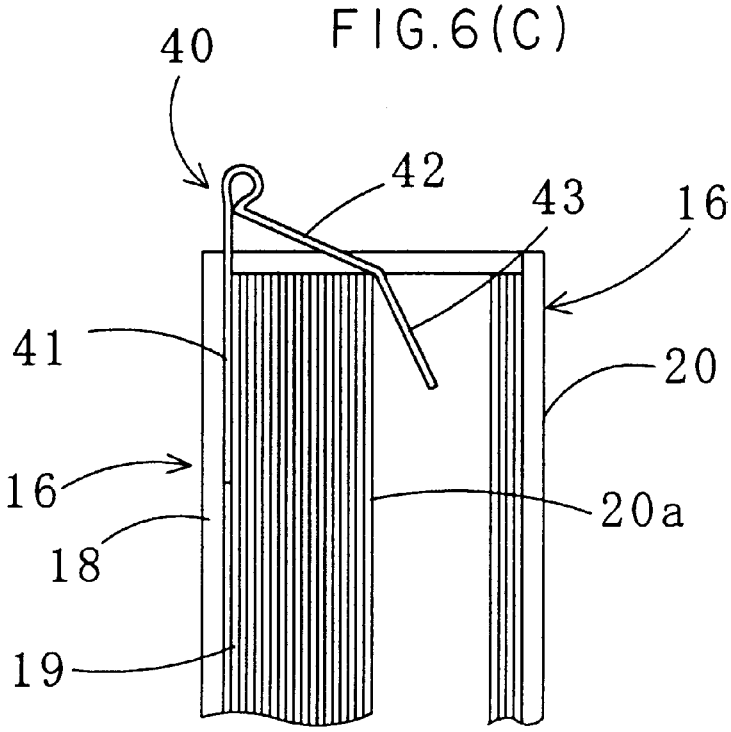

A further automatic insertion bookmark 40 according to a fourth embodiment as shown in FIG. 6 will be described. The automatic insertion bookmark 40 as illustrated in FIGS. 6(A), 6(B) and 6(C) is produced from either a sheet of synthetic resin or a paper member, both of which have elasticity and flexibility. The bookmark 40 includes a fixing portion 41, a connecting portion 42 seamlessly joined to the fixing portion 41 at an upper-central position thereof, and a bookmark portion 43 monolithically connected to a distal end of the connecting portion 42.

The fixing portion 41 is substantially identical in size to the fixing portion 12 of the automatic insertion bookmark 10 according to the first embodiment. Tile fixing portion 41 has a repeatedly jointable adhesive agent layer 44 on either the surface of the fixing portion 41 or the reverse side thereof. As shown in FIG. 6(B), when the automatic insertion bookmark 40 is used, a proximal end of the connecting portion 42 is folded back by being bent into a rounded shape. The folded connecting portion 42 is further bent outward at a substantially right angle at an intermediate portion thereof. The connecting portion 42 is held in such a bent state so as not to spring back its original shape, thereby causing the connecting portion 42 to be directed downward. Further, the bookmark portion 43, which is seamlessly joined to the distal end of the connecting portion 42, is angled downward. In this state, the fixing portion 41 is affixed to a book 16 by means of the exposed adhesive agent layer 44. More specifically, the fixing portion 41 is glued to an upper portion of either a front cover 20 of the book 16 or a back cover 18 of the book 16, or alternatively to an upper portion of a leaf 19 of the book 16 in the immediate vicinity of the front cover 20 or the back cover 18. Then, as shown in FIG. 6(C), the bookmark portion 43 is placed on an opened page 20*a*. Thus, when the book 16 is closed, then the bookmark portion 43 is interposed between pages that were opened immediately before the book 16 is closed.

According to the present invention, an alternative bookmark 40 may be employed, in which the proximal end of the connecting portion 42 is bent at a square angle, and further the bookmark portion 43 is folded downward.

When the automatic insertion bookmark 40 is used, the proximal end of the connecting portion 42 must be held in a folded state so as not to return its original shape in order to permit the bookmark portion 43 to be automatically placed on an opened page 20*a*. Meanwhile, in the previously described automatic insertion bookmarks 10, 21, 30 according to the first, second, and third embodiments, the bookmark portion is naturally directed downward because the connecting portion is mounted downward with respect to the fixing portion. This feature offers an advantage in that the bookmark portion is readily interposed between the pages of the book.

A yet further automatic insertion bookmark 46 according to a fifth embodiment will now be described with reference to FIG. 7. The automatic insertion bookmark 46 as shown in FIG. 7 is fabricated from either a sheet of synthetic resin or a paper member, both of which have elasticity and flexibility. The bookmark 46 includes a sheet of a quadrangular fixing portion 47, a connecting portion 48, and a bookmark portion 49. The connecting portion 48 is formed by a sheet different from that of the fixing portion 47. A proximal end of the connecting portion 48 is affixed to the fixing portion 47 at an upper-central position thereof. The bookmark portion 49 is integrally connected to a distal end of the connecting portion 48. An adhesive agent layer 50 is formed on either the surface of the fixing portion 47 or the reverse side thereof. The adhesive agent layer 50 is continually usable for attachment to a book etc. at a predetermined location thereof. The connecting portion 48 and the bookmark portion 49 are seamlessly joined together as one-piece, and are then band-shaped. The proximal end of the connecting portion 48 is glued to the fixing portion 47 at the upper-central portion thereof through an adhesive agent that has an increased level of adhesive strength.

Figure 7A:
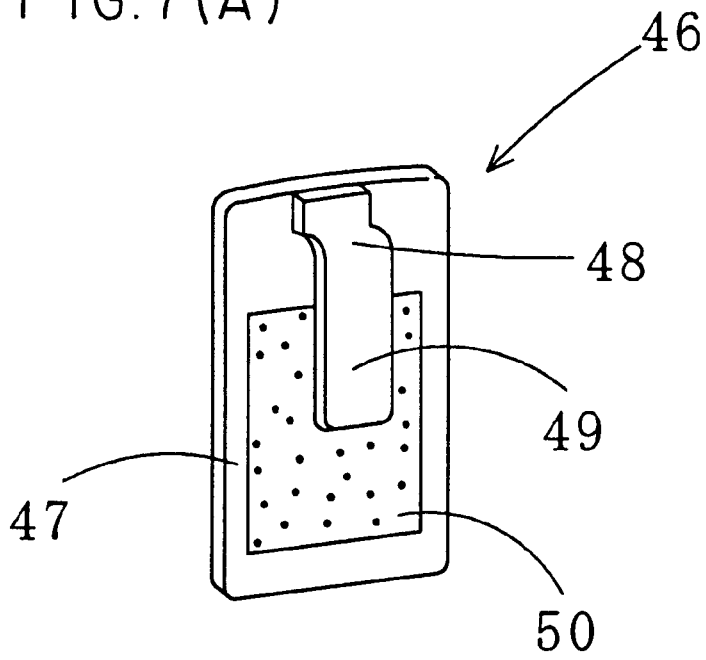
Figure 7B:
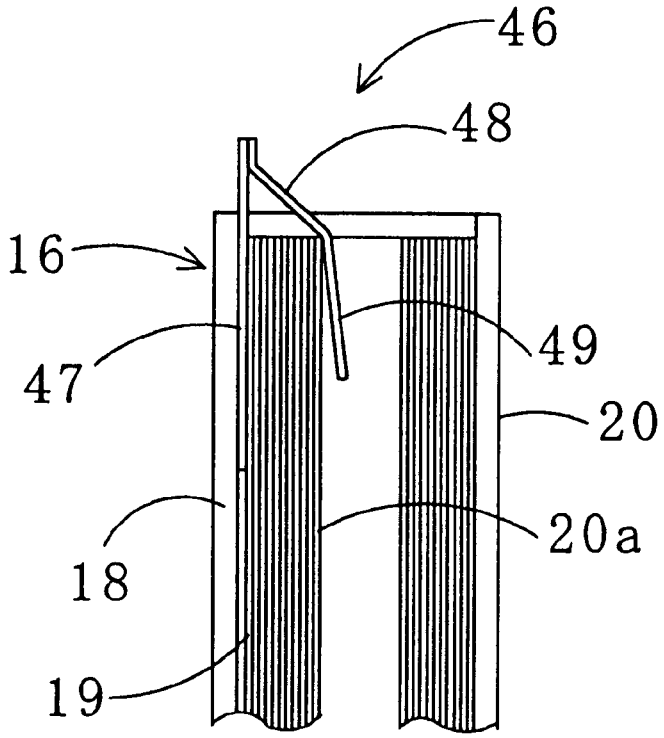

As shown in FIG. 7(A), when the automatic insertion bookmark 46 is used, the interconnected connecting and bookmark portions 48, 49 are raised from the fixing portion 47. The bookmark portion 49 is then bent downward at a portion where the connecting portion 48 and the bookmark portion 49 are seamlessly joined together. As shown in FIG. 7(B), the fixing portion 47 is affixed to a book 16 so as to expose an upper portion of the fixing portion 17. More specifically, the fixing portion 47 is glued onto either a front cover 20 of the book 16 or a back cover 18 of the book 16, or alternatively onto a leaf 19 of the book 16 in the immediate vicinity of the front cover 20 or the back cover 18. The bookmark portion 49 is then placed on a predetermined page. As a result, when the page is turned over, then the bookmark portion 49 is automatically moved onto the following page. When the book 16 is closed, then the bookmark portion 49 remains laid on a page that was opened immediately before the book 16 is closed.

In the respective embodiments as previously described, the automatic insertion bookmark assumes a planar shape before being used, while the connecting and bookmark portions are bent when the automatic insertion bookmark is used. Alternatively, the connecting portion and/or the bookmark portion may be bent to some degree in the process of manufacture of the automatic insertion bookmark.

In the above-described embodiments, specific numerals are used for convenience of description; however, the present invention is limited to neither such numerals nor the above described shapes of components. In addition, the respective sheets of the fixing, connecting, and bookmark portions are shown greater in thickness in drawings; however, these portions are actually smaller in thickness, but has elasticity and flexibility. Further, the bookmark portion is preferably transparent.

In the above-described embodiments, the automatic insertion bookmark is fixed to the book through the adhesive agent layer that is formed on one of both surfaces of the fixing portion. Alternatively, pursuant to the present invention, the fixing portion may be fitted to the book through any clamping fixture such as a clip.

Industrial Applicability

In the automatic insertion bookmark according to the present invention having the above-described construction, connecting and bookmark portions have elasticity and flexibility, the connecting portion being seamlessly joined to a fixing portion that is fixed to either a front cover of a book or a back cover of the book, or alternatively to a leaf of the book in the immediate vicinity of the front or back cover. Further, the bookmark portion is laid on an opened page of the book at an upper portion of the page. As a result, the bookmark portion is automatically placed on the following page when the page is turned over. In this way, the bookmark portion provides automatic insertion.

Consequently, the above-described bookmark saves labor in which a sheet like bookmark is manually inserted between pages that are just read, as practiced in the past. In addition, the above automatic insertion bookmark eliminates the likelihood that such a sheet-like bookmark interposed between the pages is accidentally dislodged therefrom.

Further, when the automatic insertion bookmark has an adhesive agent layer formed on either the surface of the fixing portion or the reverse side thereof, and the fixing portion is fixed to the book through the adhesive agent layer, it then ensures that the automatic insertion bookmark can be fixed to the book. In this case, the automatic insertion bookmark is continually usable when a bonding agent (e.g., a pressure sensitive adhesive) having a reduced level of adhesive strength is used to form the adhesive agent layer.

In addition, when the automatic insertion bookmark has a insertion-through hole provided at an upper portion of the fixing portion, through which the band-like bookmark and connecting portions are inserted, the bookmark portion may be directed downward. This tendency of the bookmark portion further ensures that when a page that is just read is turned over, then the bookmark portion is placed on the following page.

A further automatic insertion bookmark according to the present invention may be formed by a profile thereof being cut out from either a front cover of a book or a back cover of the book, or alternatively from a leaf of the book in the immediate vicinity of the front or back cover. In this case, a proximal end of a fixing portion is seamlessly joined to an upper portion of either the front or back cover, or alternatively to an upper portion of the aforesaid leaf. This structure eliminates the need to provide an automatic insertion bookmark separated from the book, and thus eliminates troubles such as loss of the separated bookmark.

In a yet further automatic insertion bookmark according to the present invention, interconnected connecting and bookmark portions may be formed in a sheet of a fixing portion by being cut out from the sheet of the fixing portion. As a result, the automatic insertion bookmark can be manufactured at reduced costs by means of a sheet having a reduced area.

Meanwhile, in a still further automatic insertion bookmark, interconnected connecting and bookmark portions may be seamlessly jointed as one-piece to a fixing portion at an upper portion thereof. In this case, although a sheet having a larger area is required to fabricate the automatic insertion bookmark, the automatic insertion bookmark can be manufactured in a simplified manufacturing process in which it is only necessary to cut an outer profile of the bookmark without the need to provide a nick in the sheet.

Further, in another automatic insertion bookmark, a sheet different from a sheet of a fixing portion may form interconnected connecting and bookmark portions. In this case, the bookmark portion is directed downward. As a result, the automatic insertion bookmark is folded at smaller angles at one demarcation portion between the fixing portion and connecting portion and at another demarcation portion between the connecting portion and the bookmark portion. Consequently, the bookmark portion is more readily inserted into the book at a smaller angle, thereby providing such an easy-to-use automatic insertion bookmark.

What is claimed is:

1. An automatic insertion bookmark designed to permit a bookmark portion to be automatically inserted into an placed on an opened page of a book at an upper portion of the page, comprising:

a fixing portion fixed to the book, the bookmark portion inserted between pages that are just read, and a connecting portion for connecting the fixing portion and the bookmark portion together, a proximal end of the connecting portion being connected to an upper portion of the fixing portion, the connecting portion being folded at one of a position where the connecting portion and the fixing portion are joined together and a position adjacent to the former position, the bookmark portion being folded at one of a position where the connecting portion and the bookmark portion are joined together and a position adjacent to the former position, whereby the bookmark portion is directed downward facing the fixing portion, wherein an insertion-through hole is formed at an upper portion of the fixing portion, the insertion-through hole being formed by a transversely elongated hole, through which the bookmark portion and the connecting portion can be inserted, whereby the interconnected bookmark and connecting portions are inserted through the insertion-through hole in a state of the connecting portion being folded back at a certain portion thereof.

2. An automatic insertion bookmark as defined in claim 1, wherein an adhesive agent layer is formed on one of a front side of the fixing portion and a reverse side of the fixing portion, the adhesive agent layer providing one of tentative fixing of the fixing portion and permanent fixing of the fixing portion, in order to permit the fixing portion to be fixed to one of a front cover of the book, a back cover of the book, and a leaf of the book in the immediate vicinity of one of the front and back covers, whereby the fixing portion is fixed to the book through the adhesive agent layer.

3. An automatic insertion bookmark as defined in claim 1, wherein the fixing, connecting, and bookmark portions are formed by profiles thereof being cut out from one of a front cover of the book, a back cover of the book, and a leaf of the book in the immediate vicinity of one of the front and back covers, a proximal end of the fixing portion being joined to an upper portion of one of the front cover, the back cover, and the aforesaid leaf, and wherein when the automatic insertion bookmark is used, the proximal end of the fixing portion is folded back, thereby permitting the insertion-through hole formed at the upper portion of the fixing portion to protrude from the top of the book.

4. An automatic insertion bookmark designed to permit a bookmark portion to be automatically inserted into and placed on an opened page of a book at an upper portion of the page, comprising:

a fixing portion fixed to the book, the bookmark portion inserted between pages that are just read, and a connecting portion for connecting the fixing portion and the bookmark portion together, a proximal end of the connecting portion being connected to an upper portion of the fixing portion, the connecting portion being folded at one of a position where the connecting portion and the fixing portion are joined together and a position adjacent to the former position, the bookmark portion being folded at one of a position where the connecting portion and the bookmark portion are joined together and a position adjacent to the former position, whereby the bookmark portion is directed downward facing the fixing portion, wherein an adhesive agent layer is formed on one of a front side of the fixing portion and a reverse side of the fixing portion, the adhesive agent layer providing one of tentative fixing of the fixing portion and permanent fixing of the fixing portion, in order to permit the fixing portion to be fixed to one of a front cover of the book, a back cover of the book, and a leaf of the book in the immediate vicinity of one of the front and back covers, whereby the fixing portion is fixed to the book through the adhesive agent layer, and wherein the interconnected connecting and bookmark portion are formed in a sheet of the fixing portion by being cut out from the sheet of the fixing portion, a proximal end of the connecting portion being foldably connected to an upper portion of the fixing portion, whereby when the automatic insertion bookmark is used, the bookmark portion and the connecting portion are pulled from the fixing portion, thereby forming the connecting and bookmark portions that have respective predetermined shapes.

5. An automatic insertion bookmark designed to permit a bookmark portion to be automatically inserted into an placed on an opened page of a book at an upper portion of the page comprising:

a fixing portion fixed to the book, the bookmark portion inserted between pages that are just read, and a connecting portion for connecting the fixing portion and the bookmark portion together, a proximal end of the connecting portion being connected to an upper portion of the fixing portion, the connecting portion being folded at one of a position where the connecting portion and the fixing portion are joined together and a position adjacent to the former position, the bookmark portion being folded at one of a position where the connecting portion and the bookmark portion are joined together and a position adjacent to the former position, whereby the bookmark portion is directed downward facing the fixing portion, wherein an adhesive agent layer is formed on one of a front side of the fixing portion and a reverse side of the fixing portion, the adhesive agent layer providing one of tentative fixing of the fixing portion and permanent fixing of the fixing portion, in order to permit the fixing portion to be fixed to one of a front cover of the book, a back cover of the book, and a leaf of the book in the immediate vicinity of one of the front and back covers, whereby the fixing portion is fixed to the book through the adhesive agent layer, and wherein the interconnected connecting and bookmark portions are bent by being folded back at a proximal position of the connecting portion, the connecting portion being further bent at a right angle at an intermediate position thereof in a direction opposite to the direction in which the connecting portion was previously folded back, the bookmark portion connected to a distal end of the connecting portion being further bend downward, whereby the bookmark portion remains directed downward.

* * * * *